United States Patent [19]

Nakai et al.

[11] Patent Number: 5,074,384

[45] Date of Patent: Dec. 24, 1991

[54] ROPE WEIGHT COMPENSATING DEVICE FOR A LINEAR MOTOR DRIVEN ELEVATOR

[75] Inventors: Keiichiro Nakai, Tokyo; Manabu Suganuma, Narita, both of Japan

[73] Assignee: Otis Elevator Company, Farmington, Conn.

[21] Appl. No.: 494,055

[22] Filed: Feb. 26, 1990

[30] Foreign Application Priority Data

Feb. 28, 1989 [JP] Japan ..... 1-49719

[51] Int. Cl.[5] ..... B66B 17/12

[52] U.S. Cl. ..... 187/94; 187/1 R

[58] Field of Search ..... 187/1 R, 94

[56] References Cited

U.S. PATENT DOCUMENTS

| | | | |
|---|---|---|---|
| 3,896,905 | 7/1975 | Solymos | 187/22 |
| 4,402,386 | 9/1983 | Ficheaux et al. | 187/112 |
| 4,445,593 | 5/1984 | Coleman et al. | 187/1 R |
| 4,570,753 | 2/1986 | Ohta et al. | 187/94 |
| 4,716,989 | 1/1988 | Coleman et al. | 187/1 R |
| 4,949,815 | 8/1990 | Pavoz | 187/20 |

FOREIGN PATENT DOCUMENTS

| | | | |
|---|---|---|---|
| 0100583 | 2/1984 | European Pat. Off. . | |
| 0048847 | 7/1985 | European Pat. Off. . | |
| 2348128 | 4/1975 | Fed. Rep. of Germany | 187/1 R |
| 3422374 | 12/1985 | Fed. Rep. of Germany . | |

OTHER PUBLICATIONS

European Search Report.

*Primary Examiner*—H. Grant Skaggs
*Assistant Examiner*—Dean A. Reichard
*Attorney, Agent, or Firm*—Lloyd D. Doigan

[57] ABSTRACT

The rope weight of a linear motor driven elevator is compensated by using a cable suspended from the bottom of a counterweight and from the bottom of an elevator car, the cable supplying electrical power to a moving member of the linear motor, the moving member functioning as a primary conductor.

3 Claims, 2 Drawing Sheets

ROPE WEIGHT COMPENSATING DEVICE FOR A LINEAR MOTOR DRIVEN ELEVATOR

DESCRIPTION

1. Technical Field

The invention relates to a rope weight compensating device for a linear motor driven elevator.

2. Background Art

In traction-type elevators, a rope is attached at one end thereof to a top of a car and at a second end thereof to a top of a counterweight. The ropes are guided by a sheave which is rotated by a motor. Friction between the rope and the sheave raises and lowers the car. A balancing chain or the like is attached at one end thereof to a bottom of the car and at a second end thereof to a bottom of the counterweight. The balancing chain prevents slippage of the rope upon the sheave which otherwise occurs when there is an unbalance of the weight between; a portion of the rope on the car side of the sheave and the car, and a portion of the rope on the counterweight side of the sheave and the counterweight.

In a linear motor driven elevator, on the other hand, since either the counterweight or the elevator car is driven directly by the linear motor, and the sheave acts only as a idler driven by the ropes, the problem of slippage of the rope upon the sheave does not substantially exist other than when the elevator is stopped.

However, when a counterweight, which houses the moving element of a linear motor, is positioned at its lowest level (and the elevator car is positioned at its highest level) with a load weight of zero, the energy required by the linear motor is increased because of the extra weight of the rope on the counterweight side of the sheave. Heavier wiring systems are required to provide the required power. Also, a heavier braking system is required to stop the counterweight at predetermined positions and when emergencies occur.

DISCLOSURE OF THE INVENTION

It is an object of the invention to provide a means for compensating for the rope weight in a linear motor driven elevator without using a balancing chain.

According to the invention, the rope weight of a linear motor driven elevator is compensated by using a cable suspended from the bottom of the counterweight and from the bottom of the elevator car, the cable supplying electrical power to a moving member of the linear motor which functions as a primary side of the linear motor.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
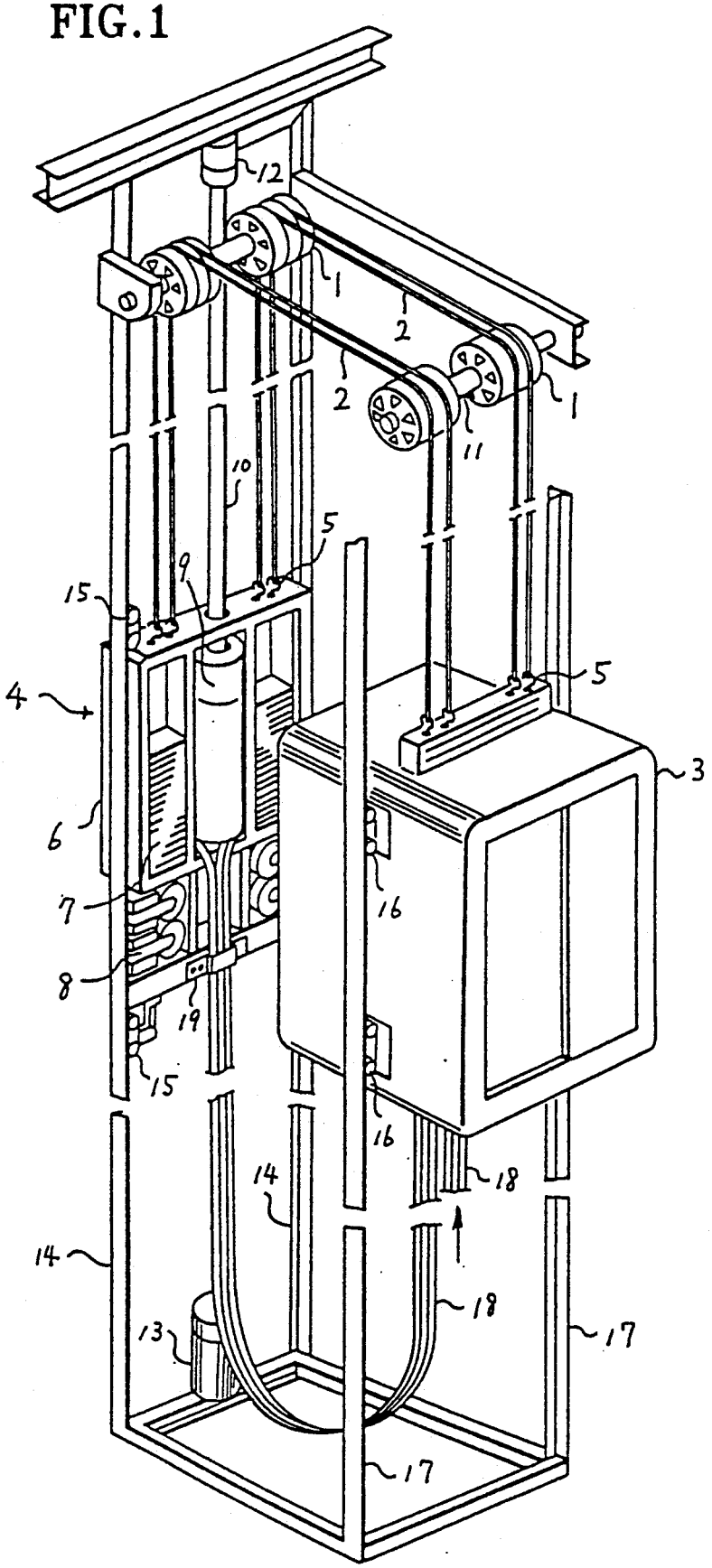
FIG. 1 is a perspective view of a linear motor driven elevator system having an embodiment of a rope compensation system according to an embodiment of the present invention.

Referring to FIG. 1, sheaves 1 guide ropes 2. The sheaves 1 are rotatably mounted upon shafts 11, which are in turn fixed to a building (not shown).

A counterweight 4 is attached to one end of the ropes via hooks 5. Elevator car 3 is attached to the other end of the ropes via hooks 5. The counterweight 4 is comprised of a frame 6, weights 7, a braking unit 8, and a moving element 9 which functions as a primary conductor of a toroidal linear motor. A column 10, which functions as a secondary conductor of the linear motor, passes through moving element 9 with a predetermined clearance therebetween. Column 10 is fixed to the building via support members 12 and 13.

The braking unit 8 engages rails 14 when the linear motor is stopped or in an emergency such as a power failure. Rollers 15, disposed upon the frame 6, rotatably engage rails 14 to guide the counterweight therealong. Similarly, rollers 16, disposed upon both sides of elevator car 3, rotatably engage rails 17 to guide the elevator car therealong.

A three phase cable 18 is suspended from the counterweight 4 by a support member 19 and then attached to the moving member 9. The cable 18 is suspended from the elevator car 3 and then connected to a three phase AC power supply (not shown). Accordingly, the moving element 9 is supplied with three phase AC power through the cable 18. The cable 18 can be attached to the bottom of the elevator car by known fixing members such as the support member 19 or the like.

Figure 2:
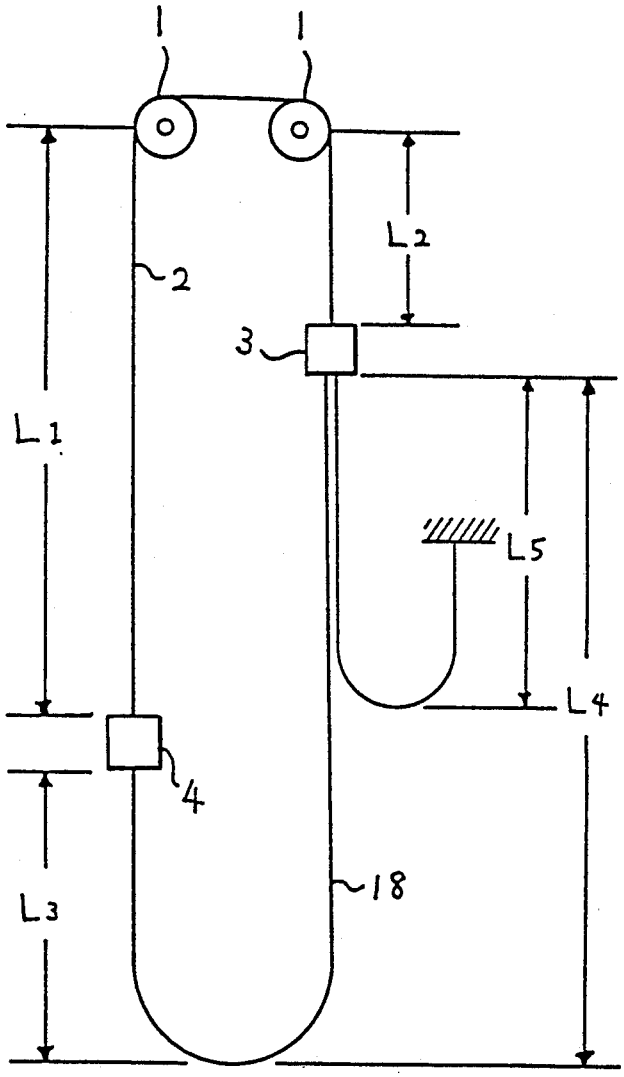
FIG. 2 is a schematic diagram of the rope compensation system of FIG. 1.

Referring to FIG. 2, when moving element 9 moves linearly by means of an electromagnetic force generated between the moving element 9 and the fixed column 10, the counterweight moves in a first direction, and the elevator car in turn travels in an opposite direction via the ropes 2. Assuming that the counterweight and the elevator car are of even weight and that the counterweight is positioned at its lower most level with the elevator car being positioned at its upper most level, and that no means for compensating the rope is provided, a rope weight corresponding to length L1–L2, which must be lifted by the linear motor, is applied to the counterweight side, thereby requiring the linear motor to utilize more power. On the contrary, when the cable 18 is provided as shown in FIG. 2, a rope weight corresponding to length L1–L2 is compensated by a rope weight corresponding to length L4–L3 so that the power required by the linear motor may be minimized.

It is noted that the cable weight corresponding to the approximate length L5 (one of ordinary skill in the art will recognize that the curved portion of the cable makes the actual length of L5 longer than the L5 shown) is also applied to the elevator car. Such cable weight provides an imbalance which is compensated for by adding a corresponding weight to the counterweight. The corresponding weight is approximately equal to the weight of the cable, having an approximate length L5, when the elevator car is positioned at half its travel stroke.

In the given embodiment, each of the three strands of cable 18 is constituted of a plurality of insulated wires and weighs 1.15 kilograms per meter. On the other hand, each rope weighs 0.55 kg/m. As such, the cable 18 functions properly as a rope weight compensating means.

It should be noted that the cable 18 connecting the moving element 9 and the elevator car may include leads supplying control signals as well as power signals. Further, though the cable 18 is shown as attaching from the power supply to the counterweight via the elevator car, it is also possible to attach the power supply to the elevator via the counterweight. In such a case, if the primary element (i.e. moving element) is mounted on the counterweight, the cable connecting the power supply in the counterweight, and the cable connecting the counterweight in the elevator car should be separate members. In such a case, if the primary element (i.e. moving element) is mounted on the counterweight, it is preferable to use cable between a counterweight and the elevator car solely as a rope compensating means. Still further, though the moving element is arranged in the counterweight in the embodiment shown, it may be alternatively provided on the elevator car side.

Although the invention has been shown and described with the respect to a best mode embodiment thereof, it should be understood that various other changes and modifications may be made without departing from the spirit and scope of this invention as defined by the following claims.

We claim:

1. An elevator comprising;

a rope having a first end and a second end, a car suspended from said first end of said rope, a counterweight suspended from said second end of said rope, a linear motor means for providing motive force for said car and said counterweight, said linear motor means having a stationary element and a moving element disposed on said counterweight, and a first cable suspended from said counterweight to said car and attaching to said linear motor moving element for providing power thereto and for providing a compensating weight for said rope.

2. The elevator as set forth in claim 1 further comprising;

a second cable being connected at a first end to the car for providing power thereto and at a second end to a power source for receiving power therefrom.

3. The elevator of claim 2 further comprising;

a second compensating weight added to the counterweight, said compensating weight corresponding approximately to a weight of a length of the second cable depending from the car between the car and the power source when said car is positioned at a half of a travel stroke thereof.

* * * * *